United States Patent [19]

Newell

[11] Patent Number: 4,686,720

[45] Date of Patent: Aug. 18, 1987

[54] COVERED HAMMOCK

[76] Inventor: Kathryn H. Newell, 119 A Pine St., Carrboro, N.C. 27510

[21] Appl. No.: 688,974

[22] Filed: Jan. 4, 1985

[51] Int. Cl.[4] ..... A45F 3/22

[52] U.S. Cl. ..... 5/121; 5/122; 5/123

[58] Field of Search ..... 5/97, 120–123, 5/413, 414, 418, 113; 135/117

[56] References Cited

U.S. PATENT DOCUMENTS

| | | | |
|---|---|---|---|
| 329,763 | 11/1885 | Nelmes | 5/121 |
| 594,598 | 11/1897 | Byxbe et al. | 5/128 |
| 773,317 | 10/1904 | Funke | 5/122 |
| 955,281 | 4/1910 | Norwood | 5/121 |
| 1,156,200 | 10/1915 | Ashworth | 5/121 |
| 1,401,846 | 12/1921 | Wiles | 5/121 |
| 2,508,254 | 5/1950 | Ham | 5/414 |
| 2,932,833 | 4/1960 | Wambach | 5/418 |
| 3,751,741 | 8/1973 | Hendry | 5/121 |
| 3,860,980 | 1/1975 | Ebert | 5/121 |
| 3,970,096 | 7/1976 | Nicolai | 135/117 |
| 4,001,902 | 1/1977 | Hall et al. | 5/121 |
| 4,071,917 | 2/1978 | Mojica | 5/121 |
| 4,093,305 | 6/1978 | Staroste et al. | 5/113 |
| 4,308,883 | 1/1982 | Malone | 5/121 |
| 4,320,542 | 3/1982 | Cohen | 5/121 |
| 4,491,141 | 1/1985 | Eppenbach | 5/414 |

*Primary Examiner*—Gary L. Smith
*Assistant Examiner*—Michael F. Trettel

[57] ABSTRACT

A covered hammock includes an upper fabric cover, comprised of an upper nonwoven fabric connected to a lower woven fabric border-supported by means of a, collapsible pole that is secured to the outside of said cover and is shaped in the form of a rounded arch that is parallel to the lateral ends of a lower fabric support which is trapezoidal in shape and whose lateral ends are adapted with means for suspension above ground to stationary fixtures such as trees. The upper fabric cover and lower fabric support are connected, by means creating an enclosed space suitable for a reclining person, and accessible by selective fasteners strategically placed in said cover. A rain cover with window and zippered opening is attachable to an upper side of said lower support and may be opened and secured in place with fasteners over said cover in inclement weather. A sun visor includes an elongated oval whose outer edges have been provided with means for inserting stiffening members therein, said stiffening members exerting an upward and outward pressure on said visor when attached along its longitudinal median to said rounded arch; the curved sides of the sun visor thereby protruding outwardly from said median over the upper fabric cover and blocking some of the sun's rays.

7 Claims, 9 Drawing Figures

COVERED HAMMOCK

BACKGROUND OF THE INVENTION

1. Field of the Invention

The invention introduced deals with a covering attached to the upper side of a hammock.

2. Description of the Prior Art

For camping and other recreational activities many tents as well as hammocks have been developed to provide shelter from insects, ground dwelling creatures, and inclement weather. Being suspended above the ground, which can be hard or bumpy, wet, cold, and dirty, hammocks provide a potentially more comfortable, dry, warm, and clean sleeping surface than do tents. Hammocks are also less accessible to ground dwelling creatures than tents are. Hammocks may be used, given the proper fixed supports, in areas that would be difficult or impossible to pitch a tent in due to rough, hilly, or wet terrain.

Many of the existing hammocks with covers are so specialized that their use is severely limited to a specific situation. Some have bulky frames that are not easily moved, while others approximate a hanging tent and are difficult to set up, requiring the use of many overhead ropes, stakes, and types of pole assemblies to stabilise the canopy. Impairment of vision while inside the covered hammock, stuffiness, restricted lateral movement, and lack of protection from the sun as well as the rain are other problems presented by previously made covered hammocks.

SUMMARY OF THE PRESENT INVENTION

The present invention, therefore, provides an improved covered hammock useful in many different situations. The hammock does not have or need any permanent stand or structure that must be transported with it. The part of the hammock upon which a person rests, the lower supporting fabric, is supported by a system independent of that supporting the upper cover. The support for the upper cover is a, collapsible pole that is threaded through a series of loops on the outside of said cover, and secured in place by means at each end of said series. This support does not use any ropes, stakes, or other supporting devices, and can hold the cover in place even if the hammock is not suspended, but placed upon the ground. This support system is very easy to make and to set up.

The upper cover is made of a nonwoven fabric such as Dacron mosquito net, bordered on its lower sides by a woven fabric such as waterproof ripstop nylon. The cover forms a lateral arch, positioned above and slightly behind the point where the occupant's head would rest in the hammock. The sides of said arch extend obliquely downward in all directions until they meet with the edges of the lower supporting fabric. The non-woven fabric provides visibility and ventilation while the border material serves as a buffer against rain that might blow up under the tarp during a storm. The arch design and materials of the upper cover thus provide maximum internal space and ventilated area for the occupant while minimizing visual impairment The lower supporting fabric is trapezoidal in shape, corresponding roughly to the shape of the human body. Lateral tension is applied to said fabric by a collapsible pole attached to each lateral end of said fabric, and parallel to said end. The poles collapse to facilitate easy storage of the covered hammock. Rope connects said poles and said fabric and is in turn attached by selective means to stationary objects such as trees a certain distance above the ground. The sleeping surface thus provided, wide at the shoulders and tapering slightly towards the feet, affords the occupant ample room for lateral movement, or turning over, within the hammock. The occupant therefore has no feeling of being cramped within a small space.

A rain cover or tarp is made of waterproof material is attachable by means to one side of the lower fabric support. The occupant may open the tarp and place it over the covered hammock during inclement weather, and secure it in place by selectively placed fasteners such as. A large window made of mosquito netting, having a protective visor on the upper side is placed on the rain cover in a position above and behind the occupant's head to ensure ventilation Any slack in the rain cover may be taken up by a cinch comprised of a strap threaded through a toggle device spaced a certain distance apart from said strap, said cinch being placed on the inside of said cover on its longest longitudinal side, between said arch and the narrowest lateral end of the lower supporting fabric (cinch not shown). The rain cover also has a zippered opening so that the occupant may leave the hammock without stowing the cover.

A sun visor is attachable to the arch support for the upper fabric cover by which are connected to the longitudinal middle of said visor. The visor is the shape of an elongated oval, whose sides have a casing which houses a stiffening member that provides upward and outward pressure on said visor when it is open. Each half of the visor opens independently of the other in accordian fashion and is secured in place above the arch support for the upper cover by straps which tie. The sun visor thus protects the face of the occupant from harmful rays of the sun if no other shelter is available, such as tree boughs.

The covered hammock in the present invention thus provides a shelter for a reclining occupant from insects, inclement weather, sun, ground dwelling and other creatures as well as ample internal space and ventilation and minimal visual impairment. The covered hammock is safe, portable, relatively light weight, and may be used in many different locations and types of terrain; it may be used as an emergency shelter on the ground as well as suspended between stationary fixtures. The covered hammock is also simple to make and to use, and is constructed in a safe and economical manner.

A BRIEF DESCRIPTION OF THE DRAWINGS

DETAILED DESCRIPTION OF THE PREFERRED EMBODIMENT

Figure 1:
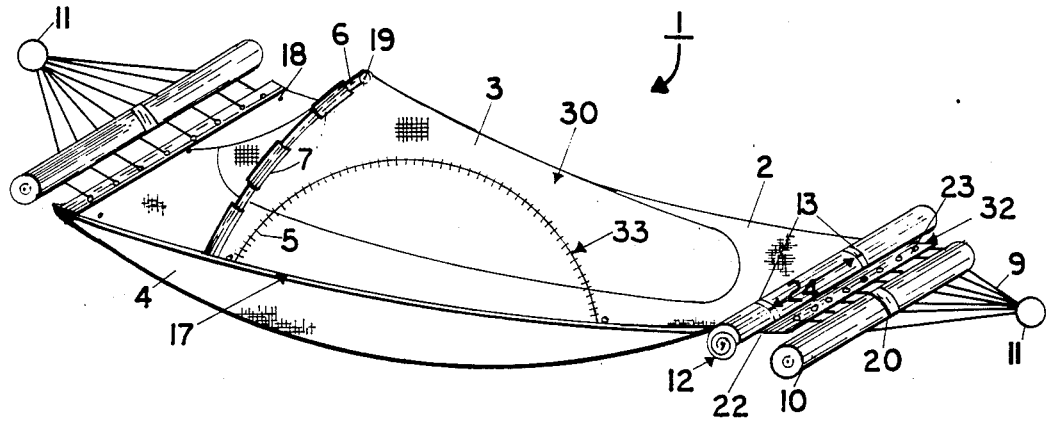
FIG. 1 is a perspective view of the embodiment of the covered hammock of the present invention.
Figure 2:
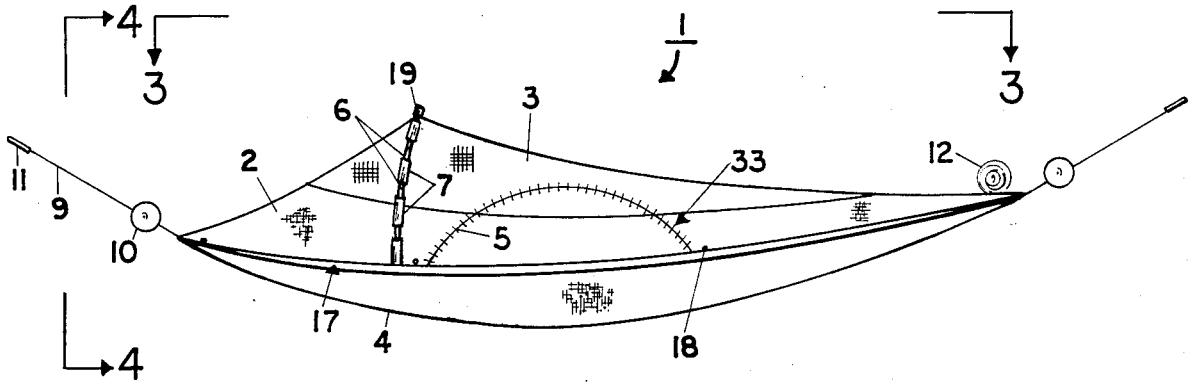
FIG. 2 is a side elevation of the embodiment of the covered hammock shown in FIG. 1.
Figure 3:
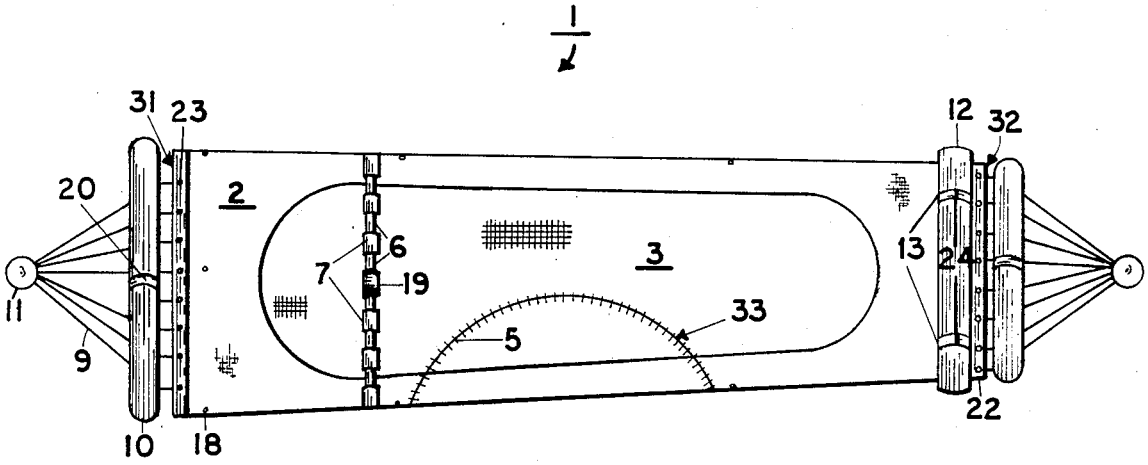
FIG. 3 is a top view of the embodiment of the covered hammock shown in FIG. 1 and FIG. 2.

The preferred embodiment of the hammock of the present invention, designated by numeral 1 has several major parts, including upper cover 30 comprised of a top non-woven fabric 3 bordered by woven fabric 2, the lower fabric support 4, the rain cover 12, and the sun visor 8 (not shown in FIG. 1). Hammock 1 has a wide lateral end 31 and a narrow lateral end 32 and the different parts and their components will be discussed below.

Upper fabric cover 30 is made of a non-woven fabric 3 such as mosquito netting, which is sewn on its lower side to a woven fabric 2. Border or lower fabric 2 may be made of a lightweight waterproof fabric and is intended to keep out water that might blow up under rain cover 12 when rain cover 12 is extended. A zipper 5 is sewn into upper fabric cover 30 for an entrance 33 in the form of an inverted U, passing through both the upper non-woven fabric 3 and the lower woven fabric 2 and meeting the lower fabric support 4 on either end.

Figure 4:
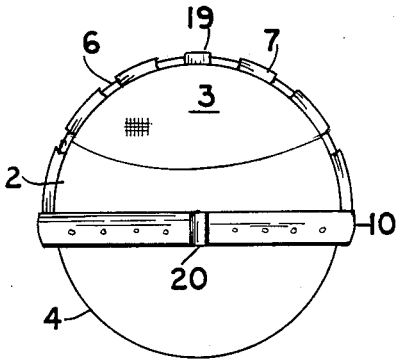
FIG. 4 is an end elevation of the embodiment of the covered hammock shown in FIGS. 1—3.

Upper cover 30 is raised above lower fabric support 4 by means of a flexible pole 6 that can be disassembled, such as formed from polybutylene and is affixed with couplings 19. Pole 6 is threaded through fabric casings 7 that are sewn to the outside of upper fabric cover 30. Casings 7 on either end of pole 6 are sewn shut on the bottom side in order to hold pole 6 in place. Pole 6 is curved to form a rounded arch member when it is received by casings 7 as seen in FIG. 4. The arch member thus formed provides a large area inside covered hammock 1, allowing the occupant to move about or shift positions as he would in a hammock without a cover. Said pole 6 and casings 7 are placed about one-sixth of the total length of hammock 1 inwardly from wide end 31 of hammock 1. The arch member is thus above and slightly behind the occupant's head and so does not block his vision while inside covered hammock 1.

Figure 9:
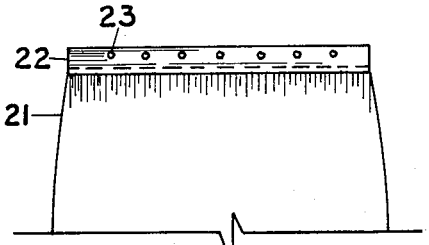
FIG. 9 is a partial bottom view of the embodiment of the covered hammock as shown in all previous FIGURES showing at the end of the hammock.

Lower fabric support 4 of covered hammock 1 is sewn to upper fabric cover 30 and is made of strong generally waterproof fabric such as waterproof nylon pack cloth. Fabric support 4 is cut in a trapezoidal shape, at the wide lateral end to support the occupant's head and torso, the narrower lateral end to support his legs and feet. Fabric support 4 at the narrower lateral end is slightly gathered as shown if FIG. 9. Gathered fabric 21 allows the occupant's feet to drop slightly so that his body is in a more prone position than it would be if fabric 21 was not so gathered. A strip 22 of fabric is sewn to gathered fabric 21. Strip 22 as well as lower fabric support 4 at wide end 31 is folded over twice, sewn down, and grommets 23 are placed at intervals in folded strip 22. Rope 9 is passed through holes in pole 10 which can be disassembled, such as formed from polyvinylchloride (PVC) and is assembled with couplings 20, and then rope 9 is passed through grommets 23 in lower fabric support 4. All strands of rope 9 extend from pole 10 to a large steel ring 11, which is the point from which hammock 1 is suspended between fixed points such as trees. The seams of lower fabric support 4 connecting it to upper fabric cover 30 are reinforced on all sides by nylon webbing 17, which is sewn to the underside of fabric support 4.

Figure 5:
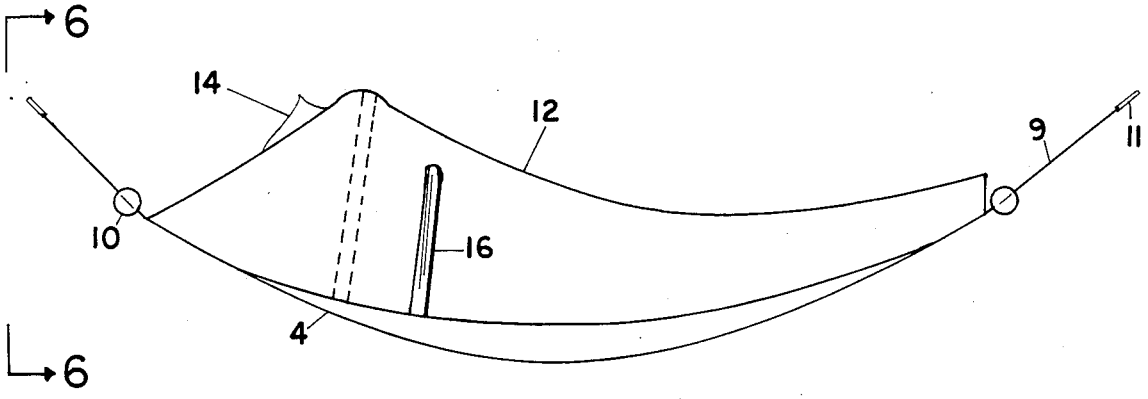
FIG. 5 is a side elevation of the covered hammock of the present invention of the embodiment showing extended rain cover.
Figure 6:
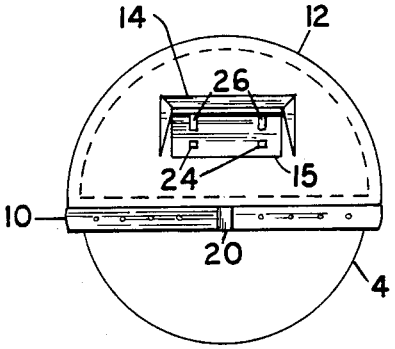
FIG. 6 is an end elevation of the embodiment of the covered hammock shown in FIG. 5.
Figure 7:
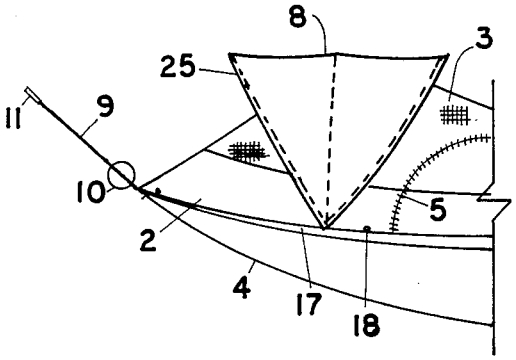
FIG. 7 is a partial side elevation of the embodiment of the covered hammock of the present invention showing placement of the sun visor in extended position.
Figure 8:
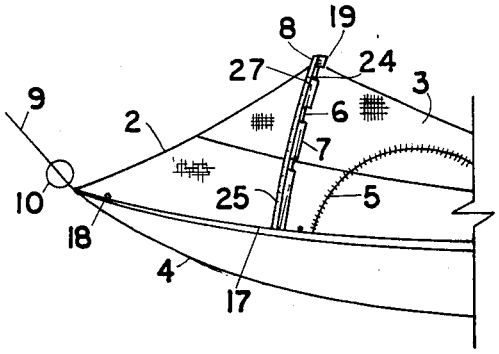
FIG. 8 is a partial side elevation of the embodiment of the covered hammock of the present invention as shown in FIG. 7 illustrating the sun visor in closed position.

Rain cover 12, made of a lightweight waterproof fabric and cut so that its shape approximates the shape of upper fabric cover 30 is attached by sewing to lower support 4 at narrow lateral end 32 and is thus secured when not in use by straps 13 with hook and loop fasteners 24. Rain cover 12 may be unrolled and extended over upper fabric cover 30 and fastened in place by snaps 18 located along upper cover 30. Rain cover 12 has a window made of mosquito net (not shown) located near wide lateral end 31 of covered hammock 1 in a position above and behind the point where the occupant's head would rest to ensure adequate ventilation. For further protection from rain, the window has a visor 14 as seen in FIG. 6 on its upper side and a flap 15 that may be unrolled. Flap 15 is secured to rain cover 12 by hook and loop fasteners 24 and has straps 26 that tie to hold flap 15 in place when it is rolled up. Rain cover 12 also has a zippered opening 16 as seen in FIG. 5 so that the occupant may leave hammock 1 without stowing rain cover 12.

A sun visor 8 is attachable to casings 7 of upper fabric cover 30 by means such as snaps placed on tabs (not shown) which are sewn to the longitudinal middle of visor 8 on the underside. Snap components on the tabs connect to corresponding components placed on casings 7 to hold visor 8 in place. Visor 8 is the shape of an elongated oval and is made of lightweight fabric such as nylon sail cloth, whose sides have been turned under and sewn to form a casing 25 which houses a stiffening member such as wire that provides upward and outward pressure on visor 8 when it is opened. Each half of visor 8 opens independently of the other half in accordian fashion and is secured in place when not in use by straps 27 with hook and loop fasteners 24 on the ends.

Various ways of making the present invention have been considered to be within the scope of the following claims which point out and claim the subject matter regarded as the invention.

I claim:

1. A hammock having a wide and a narrow end comprising:

(a) a lower support;

(b) an arch member, said arch member positioned laterally across said lower support and spaced inwardly from the wide end; and (c) an upper cover said upper cover having a lateral inverted u-shaped zipper entrance, said entrance beginning at said lower support and extending upwardly through said upper cover, said upper cover attached at one end to said arch member and extending obliquely downward therefrom to attachment with said lower support at the other end, said upper cover consisting of a non-woven top portion and a waterproof bottom portion, said top portion extending laterally across said upper cover to provide minimum visual impairment to an occupant within the hammock, and said bottom portion providing a rain barrier around the lower edge of said top portion.

2. A hammock as claimed in claim 1 and including a rain cover, said rain cover attached to said lower support for removably positioning over said upper cover.

3. A hammock as claimed in claim 2 wherein said rain cover includes fastening means, said fastening means for attaching said rain cover along said upper cover.

4. A hammock as claimed in claim 2 wherein said rain cover includes an openable entrance.

5. A hammock as claimed in claim 1 and including a sun visor, said visor attached to said arch member.

6. A hammock as claimed in claim 1 wherein said lower support is gathered at the narrow end.

7. A hammock having a narrow and a wide end comprising:

(a) a lower support;

(b) an arch member, said arch member positioned laterally across said lower support and spaced inwardly from the wide end;

(c) an upper cover, said upper cover including a plurality of casings for receiving said arch member at one end, said upper cover extending obliquely downward from said arch member to said lower support at the other end, said upper cover attached to said lower support, said upper cover consisting of a non-woven top portion and a waterproof bottom portion, said top portion extending laterally across said upper cover to provide minimum visual impairment to an occupant within the hammock, and said bottom portion providing a rain barrier, around the lower edge of said top portion;

(d) a lateral inverted U-shaped zipper entrance, said entrance beginning at said lower support and extending upwardly through said upper cover;

(e) a rain cover, said rain cover attached to said lower support for removably positioning over said upper cover, said rain cover including an openable entrance; and (f) a sun visor, said sun visor attached to said arch member, said sun visor being foldable.

* * * * *